US010580344B2

(12) United States Patent
Herrmann

(10) Patent No.: US 10,580,344 B2
(45) Date of Patent: Mar. 3, 2020

(54) VARIABLE DUTY CYCLE DISPLAY SCANNING METHOD AND SYSTEM

(71) Applicant: KOPIN CORPORATION, Westborough, MA (US)

(72) Inventor: Frederick Herrmann, Sharon, MA (US)

(73) Assignee: Kopin Corporation, Westborough, MA (US)

( * ) Notice: Subject to any disclaimer, the term of this patent is extended or adjusted under 35 U.S.C. 154(b) by 67 days.

(21) Appl. No.: 15/403,648

(22) Filed: Jan. 11, 2017

(65) Prior Publication Data

US 2017/0206829 A1 Jul. 20, 2017

Related U.S. Application Data

(60) Provisional application No. 62/278,658, filed on Jan. 14, 2016.

(51) Int. Cl.
*G09G 3/20* (2006.01)
*G09G 3/36* (2006.01)
(Continued)

(52) U.S. Cl.
CPC ..... *G09G 3/2096* (2013.01); *G09G 3/20* (2013.01); *G09G 3/3225* (2013.01);
(Continued)

(58) Field of Classification Search
CPC .. G09G 3/2096; G09G 3/3258; G09G 3/3266; G09G 3/3648; G09G 3/3696;
(Continued)

(56) References Cited

U.S. PATENT DOCUMENTS 6,473,077 B1 * 10/2002 Takenaka ..... G09G 3/3648 345/100
7,193,601 B2 * 3/2007 Furuya ..... G09G 3/3677 345/100
(Continued)

FOREIGN PATENT DOCUMENTS

EP 1 471 489 10/2004
GB 2 342 754 A 4/2000

OTHER PUBLICATIONS

International Search Report and Written Opinion issued in International Application No. PCT/US2017/013011, entitled "Variable Duty Cycle Display Scanning Method and System," dated Jun. 6, 2017, Date of Completion of Search: May 19, 2017.
(Continued)

*Primary Examiner* — Antonio Xavier
(74) *Attorney, Agent, or Firm* — Hamilton, Brook, Smith & Reynolds, P.C.

(57) ABSTRACT

A method of scanning video information to a pixel array comprises, during a first active row interval, setting a column signal line to an initial voltage, asserting a first row signal line of the pixel array, setting the column line to a desired voltage, and de-asserting the first row signal line when the column signal line is at the desired voltage. The method further comprises, during a second active row interval occurring after an amount of time, setting the column signal line to the initial voltage, asserting the first row signal line of the pixel array, and de-asserting the first row signal line while the column signal line is at the initial voltage. The method further includes, during the second active row interval, asserting a second row signal line, and maintaining the assertion of the second row line for a period of time after de-asserting the first row signal line.

14 Claims, 5 Drawing Sheets

(51) Int. Cl.
*G09G 3/3225* (2016.01)
*G09G 3/3258* (2016.01)
*G09G 3/3266* (2016.01)

(52) U.S. Cl.
CPC ..... *G09G 3/3258* (2013.01); *G09G 3/3266* (2013.01); *G09G 3/3648* (2013.01); *G09G 3/3696* (2013.01); *G09G 2300/0842* (2013.01); *G09G 2310/0202* (2013.01); *G09G 2310/027* (2013.01); *G09G 2310/0259* (2013.01); *G09G 2310/061* (2013.01); *G09G 2310/066* (2013.01); *G09G 2310/08* (2013.01); *G09G 2320/0261* (2013.01); *G09G 2320/0646* (2013.01)

(58) Field of Classification Search
CPC ..... G09G 2300/0842; G09G 2310/061; G09G 2310/08; G09G 2310/0202; G09G 2320/0646
See application file for complete search history.

(56) References Cited

U.S. PATENT DOCUMENTS

2003/0169247 A1* 9/2003 Kawabe ..... G09G 3/342 345/204
2004/0141094 A1* 7/2004 Kumamoto ..... G09G 3/3406 348/554
2004/0171221 A1* 9/2004 Takatori ..... G09G 3/3648 438/281
2007/0211009 A1* 9/2007 Teranishi ..... G09G 3/3648 345/98
2008/0062340 A1* 3/2008 Um ..... G02F 1/136213 349/38
2009/0051641 A1* 2/2009 Irie ..... G09G 3/3648 345/96
2009/0273557 A1* 11/2009 Song ..... G09G 3/3614 345/100
2010/0103339 A1* 4/2010 Shimoshikiryoh .. G09G 3/3648 349/39
2010/0118012 A1* 5/2010 Irie ..... G09G 3/3648 345/211
2011/0115779 A1* 5/2011 Fujikawa ..... G09G 3/3614 345/212
2016/0155405 A1* 6/2016 Kim ..... G09G 3/003 345/213

OTHER PUBLICATIONS

Invitation to Pay Additional Fees, and Where Applicable, Protest Fee for PCT/US2017/013011 dated Mar. 22, 2017 entitled Variable Duty Cycle Display Scanning Method and System.

* cited by examiner

VARIABLE DUTY CYCLE DISPLAY SCANNING METHOD AND SYSTEM

RELATED APPLICATION

This application claims the benefit of U.S. Provisional Application No. 62/278,658, filed on Jan. 14, 2016, the entire teachings of which are incorporated herein by reference.

BACKGROUND

Due to their many advantages in power, volume, cost, and performance, flat panel displays have now almost entirely supplanted cathode ray tubes (CRTs). CRTs, however, did have one advantage that many modern displays lack. In a CRT device, after the electron beam scans the phosphor, the phosphor naturally fades to black until it is stimulated again. In contrast, the pixels of many flat panel displays maintain their bright or dark states from one frame to the next. The persistence of such flat panel displays may cause motion artifacts (e.g., tailing) to be perceived as the eye scans across the image.

Some flat panel displays mitigate such motion artifacts by black frame insertion, which requires doubling the frame rate and driving alternate frames black. Black frame insertion requires higher video bandwidth to the pixel array, with associated higher power and complexity.

Liquid crystal displays (LCDs) may adopt a similar technique by pulsing the back light, so that pixels are illuminated for a shorter period. However, non-uniformity problems may result as pixels near the top of the display are scanned earlier than those near the bottom, and so have a different phase relationship to the backlight timing.

Further mitigation may be possible with a segmented backlight synchronized to the scanning of the pixel array, but this adds complexity and in any case is impractical for certain applications (e.g., microdisplays) that are illuminated by a single LED backlight. Other displays may achieve global blanking by controlling one or more common signals to the pixel array, such as VCOM in the case of an LCD, or the anode or cathode supplies in an organic light emitting diode (OLED) display. Such techniques, however, may have uniformity issues similar to those described for backlight blanking in the preceding paragraph.

In many liquid crystal display (LCD) configurations, and particularly those employing the commonly-used twisted nematic (TN) phase, the brightness of a pixel is modulated by the voltage applied across the liquid crystal (LC) cell. The voltage affects the degree to which the LC material rotates polarized light, which in turn controls how much light passes through an exit polarizer. In other words, an LCD is a passive device that acts as a light valve. The managing and controlling of data to be displayed is typically performed by one or more circuits, which are commonly referred to as display driver circuits or simply drivers.

Grayscale can be achieved by driving varying analog voltages to LCD pixels. Analog video amplifiers are often used in the video signal path of LCD driven circuits. If the video signal source is digital, then one or more digital-to-analog converters (DACs) will typically be used to convert the digital video signal into a corresponding analog video signal.

SUMMARY OF THE INVENTION

The described embodiments present a method for scanning flat panel displays using a variable duty cycle of the pixel's active interval, to achieve results similar to that of a CRT and thereby reduce motion artifacts.

One benefit of the described embodiments is that varying the duty cycle provides a convenient way to adjust display brightness without loss of dynamic range. The embodiments do not require any significant increase to video bandwidth, and its implementation requires no additional circuitry in the pixel array.

In one aspect, the invention is a method of resetting a row of pixels in a pixel array to a predetermined optical transmission level, comprising setting a column signal line of the pixel array to an initial voltage, asserting a row signal line of the pixel array while the column line is at the initial voltage, and de-asserting the row signal line of the pixel array prior to the column signal line changing from the initial voltage.

In embodiments, the initial voltage corresponds to a level of transparency for each pixel of the pixel array. The level of transparency may be opaque, or a level between transparent and opaque. De-asserting the row signal line may cause a storage capacitor to retain the initial voltage. The storage capacitor may be associated with a particular pixel so that the voltage across the storage capacitor is applied to the pixel. Asserting the row signal line and the de-asserting the row signal line may produce a pulse on the row signal line. The pulse may be long enough to cause the storage capacitor to stabilize at the initial voltage, and short enough to exclude a voltage change of the column line. Asserting the row signal line may cause the column signal line to be coupled to a storage capacitor associated with a pixel of the pixel array.

In another aspect, the invention is a method of scanning video information to a pixel array comprising, during a first active row interval, setting a column signal line to an initial voltage, asserting a first row signal line of the pixel array, setting the column signal line to a desired voltage, and de-asserting the first row signal line when the column signal line is at the desired voltage. The method further comprises, during a second active row interval that occurs after an amount of time from the first active row interval, setting the column signal line to the initial voltage, asserting the first row signal line of the pixel array, and de-asserting the first row signal line while the column signal line is at the initial voltage.

In another aspect, the invention is pixel matrix scanning system, comprising a pixel array, and a column driving subsystem and a row driving subsystem. The column driving and row driving subsystems are configured to, during a first active row interval, set a column signal line to an initial voltage, assert a first row signal line of the pixel array, set the column signal line to a desired voltage, and de-assert the first row signal line when the column signal line is at the desired voltage. The column driving and row driving subsystems are further configured to, during a second active row interval that occurs after an amount of time from the first active row interval, set the column signal line to the initial voltage, assert the first row signal line of the pixel array, and de-assert the first row signal line while the column signal line is at the initial voltage.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

A description of example embodiments of the invention follows.

The teachings of all patents, published applications and references cited herein are incorporated by reference in their entirety.

Figure 1B:
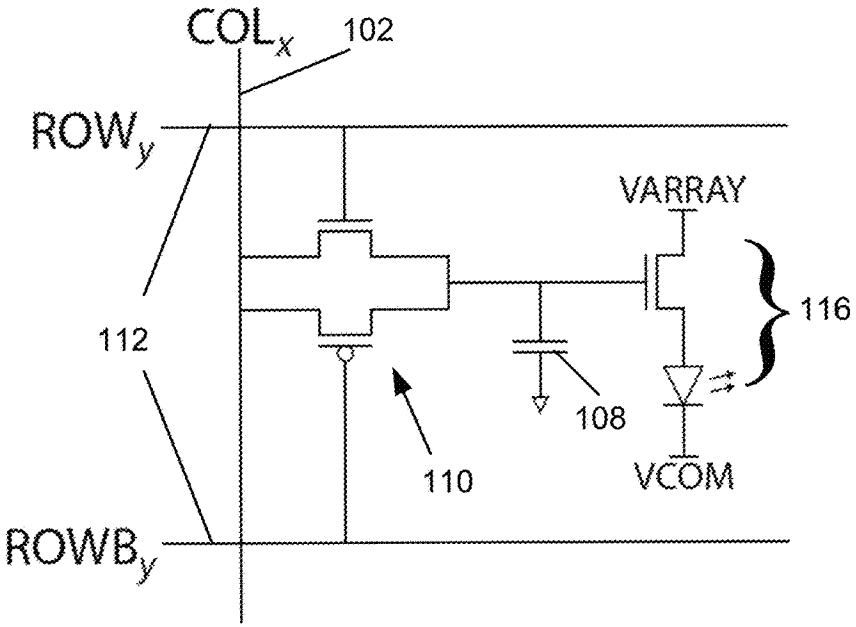
FIG. 1B shows a representative LCD active matrix pixel circuit according to the described embodiments of the invention.
Figure 1A:
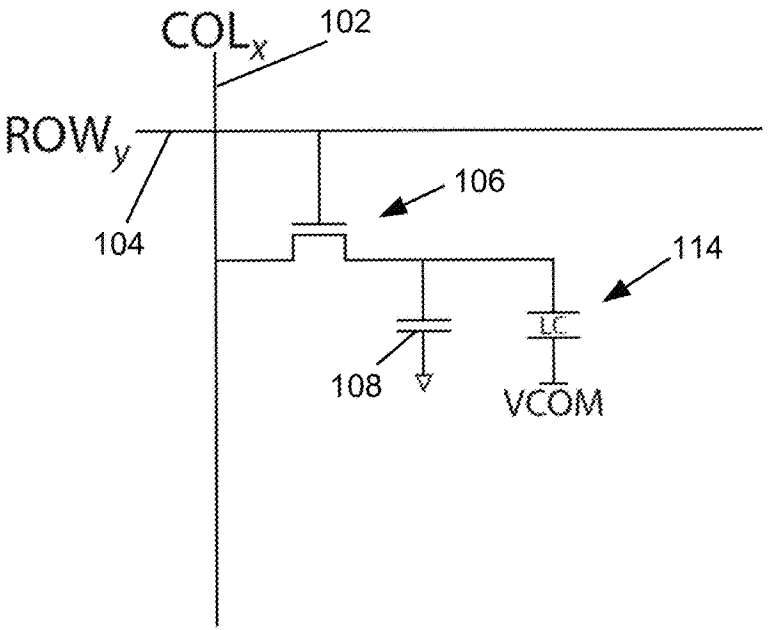
FIG. 1A shows a representative LCD active matrix pixel circuit according to the described embodiments of the invention.

Representative LCD and OLED active matrix pixel circuits are shown in FIGS. 1A and 1B, respectively. In the example depicted in FIG. 1A, a signal voltage is presented on a column line 102 ($COL_X$), and a row line 104 ($ROW_Y$) controls a switch transistor 106 capable of writing the column voltage to a storage capacitor 108. The OLED example utilizes a complementary pair of switch transistors 110 controlled a set of complementary row lines 112 ($ROW_Y/ROWB_Y$). The voltage stored on the capacitor 108 controls the liquid crystal cell 114 (LCD) or source follower circuit 116 (OLED) and thereby modulates the light transmitted or emitted from the pixel.

In some embodiments, a display element associated with the active matrix pixel circuits of FIG. 1A (LCD) and FIG. 1B (OLED) may be a Wide Video Graphics Array (WVGA) display sold under the trade name "CYBERDISPLAY® WVGA LV" manufactured by the instant Assignee. The display element can be a color filter, wide format, active matrix liquid crystal display having a resolution of 854×480. In other embodiments, the display element may alternatively include a Super Video Graphics Array (SVGA) display sold under the trade name "CYBERDISPLAY® SVGA LVS", which is also manufactured by the instant Assignee. The display element can be a color filter, active matrix liquid crystal display having a resolution of 800×600. Other display elements are contemplated, such as those described in detail in U.S. Pat. Nos. 8,378,924, and 9,116,340, which are incorporated herein by reference in their entirety. The described embodiments are not limited by any specific display element, and can be used with any lightweight display known in the art that utilize active matrix pixel circuits such as those presented in the example circuits of FIGS. 1A and 1B.

Figure 1C:
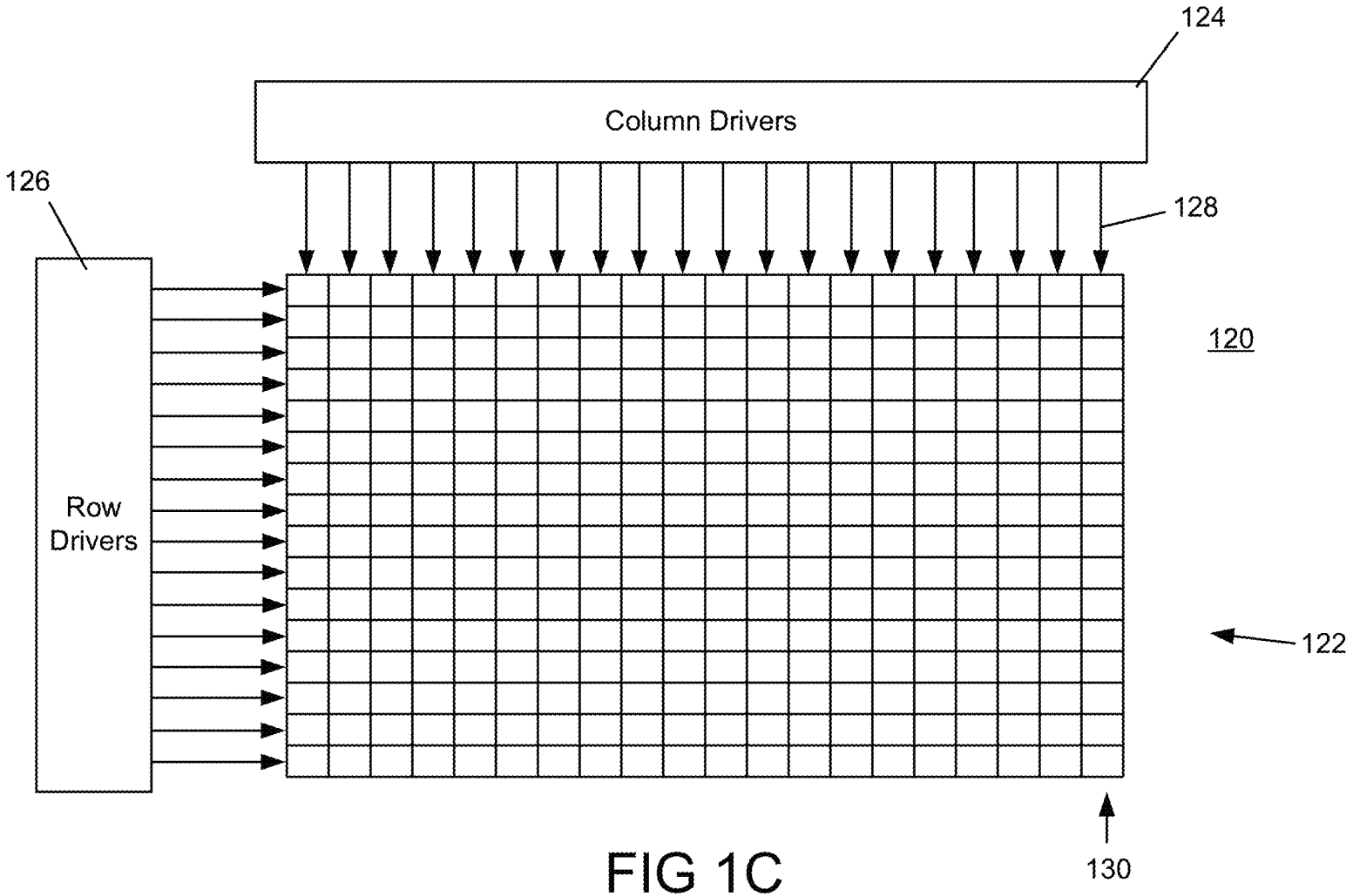
FIG. 1C shows an example embodiment of a pixel matrix scanning system constructed according to the described embodiments of the invention.

FIG. 1C shows an example embodiment of a pixel matrix scanning system 120, including a pixel array 122 driven by a number of data and control signals. In this simple example, the pixel array 122 includes 20 columns and 16 rows for a total of 320 pixels. As described above, actual micro-display pixel arrays generally have many more pixels.

The pixel array 122 includes column drivers 124 and row drivers 126 that together provide information to the pixel array 122. The column drivers 124 generally provide image information to the pixels, and the row drivers 126 provide control information to the pixels. A column driver signal 128 for a particular a particular pixel column 130 may include multiple signals, such as for a Red-Green-Blue (RGB) pixel array.

Figure 2:
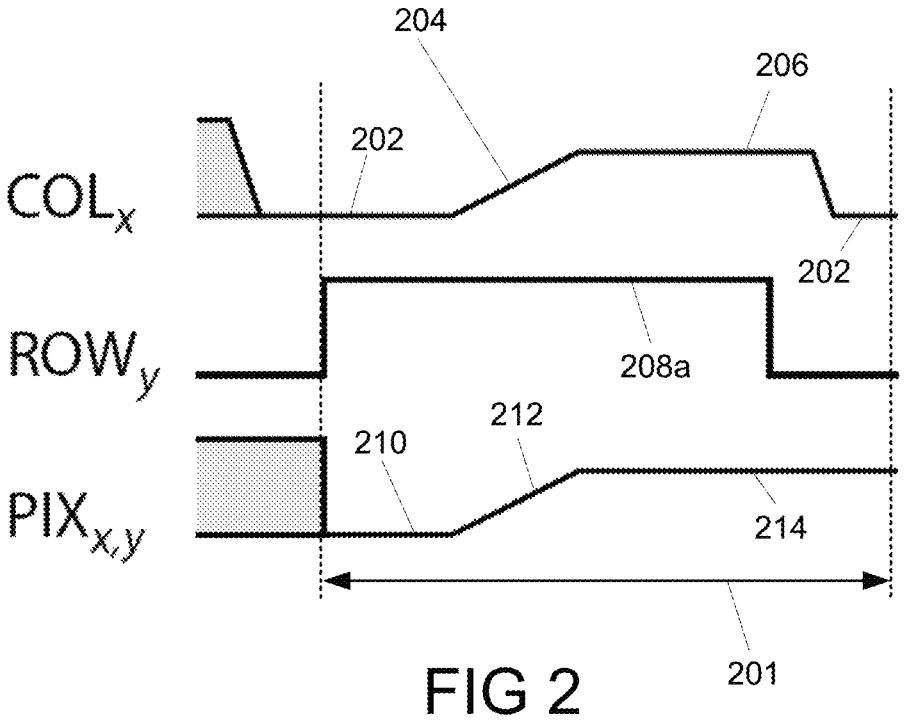
FIG. 2 shows a timing diagram associated with the pixels shown in FIGS. 1A and 1B.

FIG. 2 is an example timing diagram for the pixel circuit of FIG. 1A. Similar timing may be derived for the complementary row lines 112 of example OLED circuit of FIG. 1B. The row line 104 is asserted to an active voltage 208*a* at the beginning of the active row interval 201. All common lines are typically reset to a common voltage at the beginning of the row interval, to improve uniformity.

At some time during the active row interval 201, the column voltage will be driven from an initial reset voltage level 202, through a transition 204, to the desired voltage 206. While the row line 104 is asserted, the pixel voltage (e.g., the voltage across storage capacitor 108) follows the column signal from an initial voltage 210, through a transition 212 to a target voltage 214.

The column timing depends on the drive method used, and possibly also on the pixel's horizontal position in the array. The row interval 201 ends as the row line is de-asserted. The column line then returns to the initial reset voltage 202 in preparation for the write cycle of the next row. The pixel voltage, however, maintains the level 214 just stored, because the row line is de-asserted while the column voltage is still at the desired voltage 206, i.e., prior to the column voltage transitioning from the desired voltage 206 to the reset voltage 202.

Figure 3:
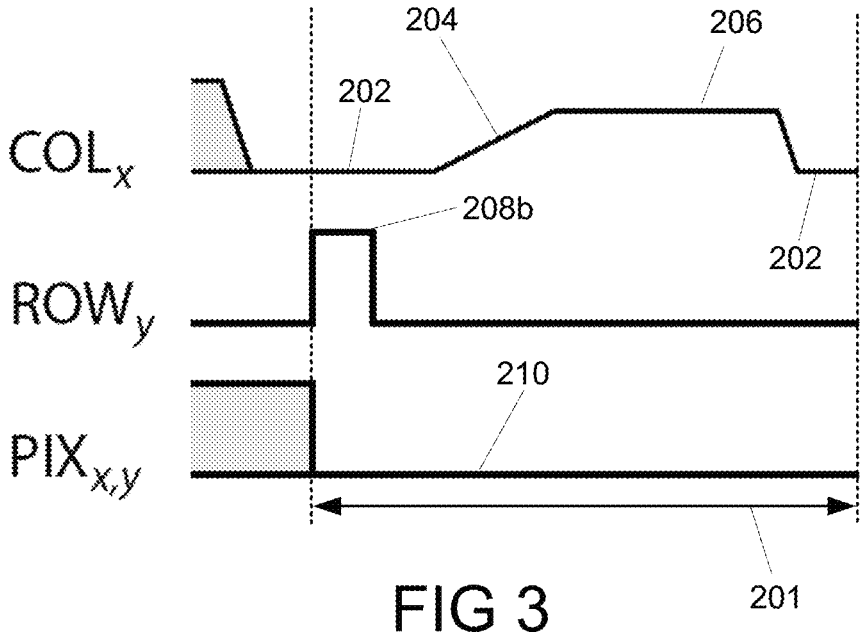
FIG. 3 shows a timing diagram according to the described embodiments of the invention.

If, however, as depicted in the example embodiment of FIG. 3, the row line is asserted to an active voltage 208*b* for only a short time (i.e., pulsed) while the column voltage is at the initial reset voltage 202, and subsequently de-asserted before the column voltage begins to transition, then the pixel storage capacitor 108 will store the reset voltage 202. For this example embodiment, the reset voltage 202 is chosen to implement the black level (e.g., opaque), so this pulse provides a quick way to drive a row to black. In other embodiments, the column voltage present during which the row line is pulsed 208*b* may be alternative voltages for resetting the row of pixels to a different level of transparency, corresponding to an optical characteristic other than black.

Figure 4:
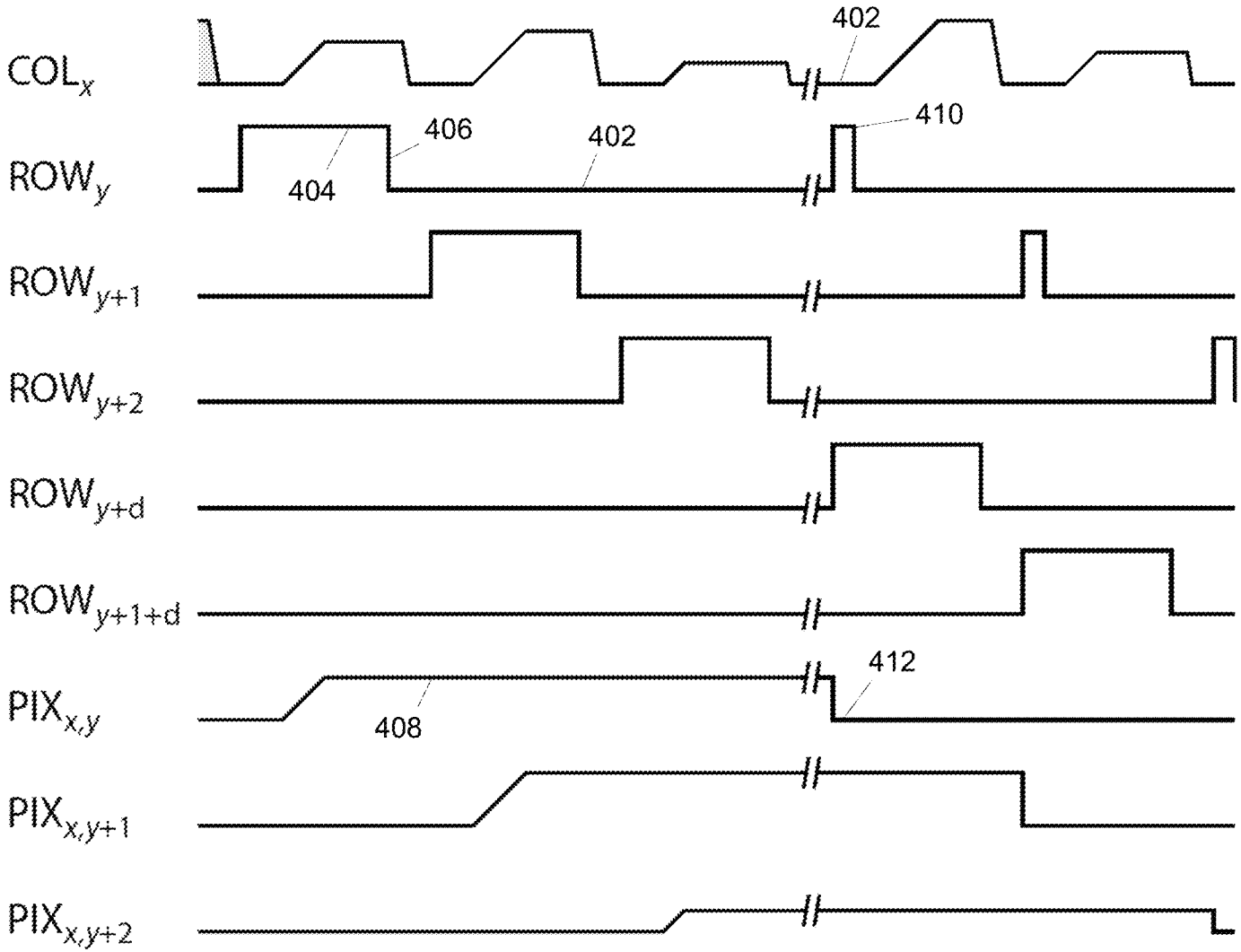
FIG. 4 shows another timing diagram according to the described embodiments of the invention.

Some embodiments may operate to reset one row during another row's normal write cycle. In the example of FIG. 4, the row line for row y is asserted to an active voltage 404. When the row line for row y drops 406, the row y pixel value 408 retains the column voltage value at the time the row y line drops 406. After d row intervals, the row line for row y is pulsed 410 while the column voltage is at the initial reset voltage 402, which causes the pixel value 412 to retain the initial reset voltage 402. The example of FIG. 4 shows that, by performing a reset pulse on a row some d row intervals after writing that row, the pixel's active period is limited to d row periods. For these embodiments, a row is written with video information, then d row periods later the row is reset to black with a pulsed row line signal 410 (or other predetermined transparency level, depending on the column voltage when pulsed row line signal 410 occurs). If the vertical timing has V lines per frame, the effective duty cycle will be $(d/V)\times 100\%$.

Figure 5:
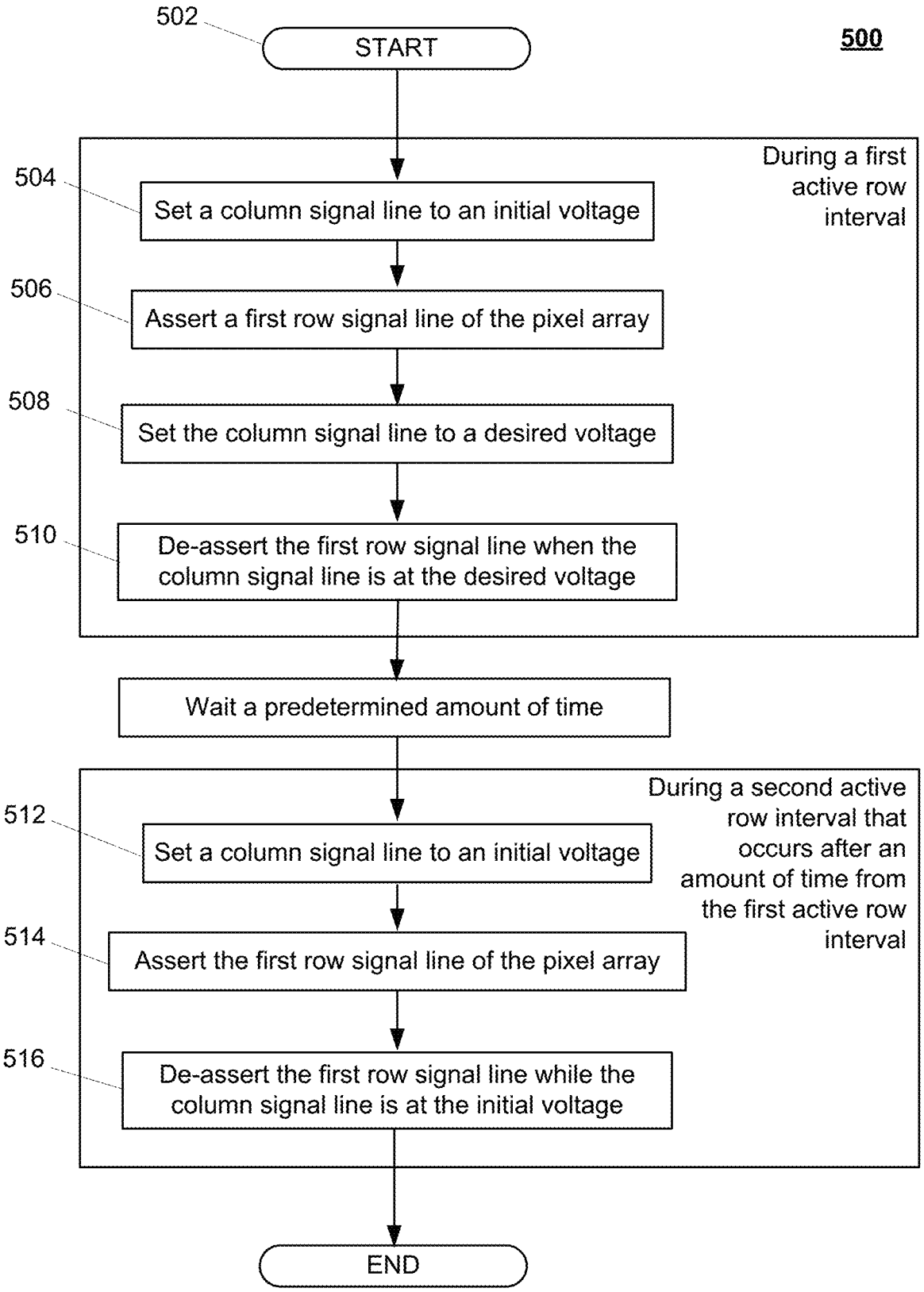
FIG. 5 illustrates an example process directed to scanning video information to a pixel array.

FIG. 5 illustrates an example process 500 directed to scanning video information to a pixel array. At the start 502 of the process, during a first active row interval, the process includes setting 504 a column signal line to an initial voltage, asserting 506 a first row signal line of the pixel array, setting 508 the column signal line to a desired voltage, and de-asserting 510 the first row signal line when the column signal line is at the desired voltage. During a second active row interval that occurs after an amount of time from the first active row interval, the process includes setting 512 the column signal line to the initial voltage, asserting 514 the first row signal line of the pixel array, and de-asserting 516 the first row signal line while the column signal line is at the initial voltage.

While this invention has been particularly shown and described with references to example embodiments thereof, it will be understood by those skilled in the art that various changes in form and details may be made therein without departing from the scope of the invention encompassed by the appended claims.

What is claimed is:

1. A method of scanning video information to a pixel array, comprising:

during a first active row interval:

setting a column signal line to an initial voltage;

asserting a first row signal line of the pixel array while the column line is at the initial voltage;

after the first row signal line is asserted, driving the column signal line from the initial voltage, through a transition, to a desired voltage, while the first row signal line remains asserted;

de-asserting the first row signal line when the column signal line is at the desired voltage;

during a second active row interval that occurs after an amount of time from the first active row interval:

setting the column signal line to the initial voltage;

asserting the first row signal line of the pixel array while the column line is at the initial voltage; and de-asserting the first row signal line while the column signal line is at the initial voltage.

2. The method of claim 1, wherein the initial voltage corresponds to a level of transparency for each pixel of the pixel array.

3. The method of claim 2, wherein the level of transparency is opaque.

4. The method of claim 1, wherein de-asserting the row signal line causes a storage capacitor to retain the initial voltage.

5. The method of claim 1, wherein the asserting the row signal line and the de-asserting the row signal line produces a pulse on the row signal line.

6. The method of claim 1, wherein asserting the row signal line causes the column signal line to be coupled to a storage capacitor associated with a pixel of the pixel array.

7. The method of claim 1, wherein during the second active row interval, asserting a second row signal line.

8. The method of claim 7, further including maintaining the assertion of the second row line for a period of time after de-asserting the first row signal line.

9. A pixel matrix scanning system, comprising:

a pixel array;

a column driving subsystem and a row driving subsystem, configured to:

during a first active row interval:

set a column signal line to an initial voltage;

assert a first row signal line of the pixel array while the column line is at the initial voltage;

after the first row signal line is asserted, driving the column signal line from the initial voltage, through a transition, to a desired voltage; and de-assert the first row signal line when the column signal line is at the desired voltage;

during a second active row interval that occurs after an amount of time from the first active row interval:

set the column signal line to the initial voltage;

assert the first row signal line of the pixel array while the column line is at the initial voltage; and de-assert the first row signal line while the column signal line is at the initial voltage.

10. The method of claim 9, wherein the initial voltage corresponds to a level of transparency for each pixel of the pixel array.

11. The method of claim 9, wherein de-asserting the row signal line causes a storage capacitor to retain the initial voltage.

12. The method of claim 9, wherein asserting the row signal line causes the column signal line to be coupled to a storage capacitor associated with a pixel of the pixel array.

13. The method of claim 9, wherein during the second active row interval, asserting a second row signal line.

14. The method of claim 13, further including maintaining the assertion of the second row line for a period of time after de-asserting the first row signal line.

* * * * *